US006062696A

United States Patent [19]

Bordovsky et al.

[11] Patent Number: 6,062,696

[45] Date of Patent: May 16, 2000

[54] PLAY TUNNEL WITH SURROUNDVIEW DISPLAY PORTALS

[75] Inventors: Robert D. Bordovsky, Arlington; Richard B. Hughs, Grapevine; Patricia Harris, Arlington, all of Tex.

[73] Assignee: Redifun Stimulation, Inc., Southlake, Tex.

[21] Appl. No.: 09/261,014

[22] Filed: Mar. 2, 1999

Related U.S. Application Data

[60] Provisional application No. 60/077,959, Mar. 13, 1998.

[51] Int. Cl.[7] ..... G03B 21/14

[52] U.S. Cl. ..... 353/79; 353/28

[58] Field of Search ..... 353/74, 77, 78, 353/94, 122, 79, 28; 359/451, 450; 472/137; 482/35

[56] References Cited

U.S. PATENT DOCUMENTS

| | | | |
|---|---|---|---|
| 3,792,914 | 2/1974 | Elias | 353/7 |
| 4,262,900 | 4/1981 | Vinson | 482/35 |
| 4,447,055 | 5/1984 | Ahrens | 482/36 |
| 4,473,355 | 9/1984 | Pongratz | 434/44 |
| 4,864,390 | 9/1989 | McKechnie et al. . | |
| 5,457,508 | 10/1995 | Ichihara et al. | 353/10 |
| 5,532,763 | 7/1996 | Janssen et al. | 348/744 |
| 5,695,406 | 12/1997 | Park | 472/61 |

*Primary Examiner*—William Dowling

*Attorney, Agent, or Firm*—Sidney L. Weatherford; Dan E. Venglarik

[57] ABSTRACT

A bubble-shaped display screen is adapted to fit over a "fish-eye" portal to a modular playground compartment, and may either replace or augment the transparent portal window. A projection device projects video images into the display screen. The display screen and projection device may be contained within an encapsulating enclosure which readily attaches to the modular playground compartment over an existing portal, allowing retro-fitting of existing playground structures. A beam-splitter and mirrors permit the projected video image to be viewed on either of two display screens mounted on either end of the enclosure encapsulating the projection device, permitting children within the playground structure and individuals outside the playground structure to view the same image.

18 Claims, 1 Drawing Sheet

PLAY TUNNEL WITH SURROUNDVIEW DISPLAY PORTALS

This application claims benefit of Provisional Appl 60/077,959 filed Mar. 13, 1998.

BACKGROUND OF THE INVENTION

1. Technical Field

The present invention relates generally to modular play equipment for children and in particular to modular play equipment having portals. Still more particularly, the present invention relates to a display device for a modular playground compartment.

2. Description of the Related Art

Modular play equipment for children has become extremely common in "fast food" and/or family restaurants, businesses devoted to provide recreational facilities for children, and other settings. Such equipment typically comprises a maze-like, multilevel modular structure having one or more compartments connected by cylindrical tunnels in different directions. These structures are typically surrounded by netting, or the like, and include "fish-eye" portals within individual compartments.

Children are increasingly focused on or motivated by visual stimulation, even during dynamic activities such as play or exercise within playground equipment of the type described. Additionally, marketing research indicates that children influence family spending, even outside the realm of discretionary spending, to a much greater degree than previously thought.

It is desirable, therefore, to provide a visual display apparatus for modular playground structures of the type known in the art. It would further be advantageous for the display device to conform to the existing features of the modular playground structure while providing a novel display region.

SUMMARY OF THE INVENTION

A bubble-shaped display screen is adapted to fit over a "fish-eye" portal to a modular playground compartment, and may either replace or augment the transparent portal window. A projection device projects video images into the display screen. The display screen and projection device may be contained within an encapsulating enclosure which readily attaches to the modular playground compartment over an existing portal, allowing retro-fitting of existing playground structures. A beam-splitter and mirrors permit the projected video image to be viewed on either of two display screens mounted on either end of the enclosure encapsulating the projection device, permitting children within the playground structure and individuals outside the playground structure to view the same image.

BRIEF DESCRIPTION OF THE DRAWINGS

The novel features believed characteristic of the invention are set forth in the appended claims. The invention itself, however, as well as a preferred mode of use, further objectives and advantages thereof, will best be understood by reference to the following detailed description of an illustrative embodiment when read in conjunction with the accompanying drawings, wherein:

DETAILED DESCRIPTION

Figure 1:
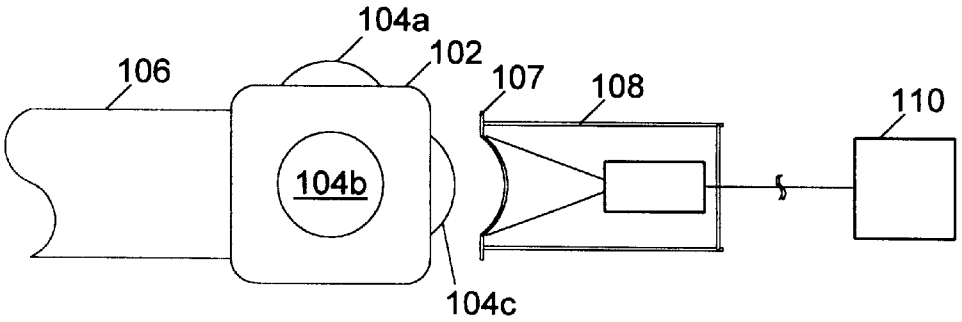
FIG. 1 depicts a diagram of a display device for a modular playground structure in accordance with a preferred embodiment of the present invention.

With reference now to the figures, and in particular with reference to FIG. 1, a diagram for a display device for a modular playground structure in accordance with a preferred embodiment of the present invention is depicted. A modular playground compartment 102 having a number of "fish-eye" portals 104*a*–104*c* is connected to a remainder of the modular playground structure (not shown) via cylindrical tunnel 106. A translucent display screen 107 fits over at least one of portals 104*a*–104*c*, and is coated with a film refracting light projected onto one surface. An image projected onto one surface of display screen 107 is visible on the opposite surface of display screen 107.

Display screen 107 is adapted to fit over a portal of a modular playground compartment. The portal may already include a shatter-resistant, transparent plastic bubble cover, in which case display screen 107 preferably fits over the bubble cover. Alterantively, the portal may not be covered but may include a projecting rim extending perpendicularly from the modular compartment surface, or curving from the modular compartment surface to extend generally perpendicularly with respect to that surface. In either instance, display screen 107 should include a region near the periperhy adapted to receive the projecting rim. Display screen 107 also preferably includes a lip projecting radially outward from the periphery of display screen 107, which may be utilized to affix display screen 107 to the modular payground compartment.

Display device 108 attaches to compartment 102 over portal 104*c*. Display device 108 is electrically connected to remote playback device 110, which may be data processing system equipment with image generation software, a video cassette recorder, or any other suitable video device.

Figure 2A:
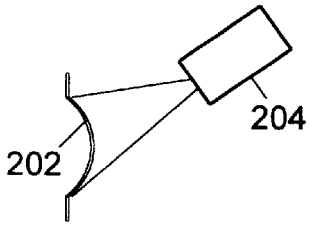
FIGS. 2A–2E are alternative embodiments of a display device for use with a modular playground structure in accordance with a preferred embodiment of the present invention.
Figure 2B:
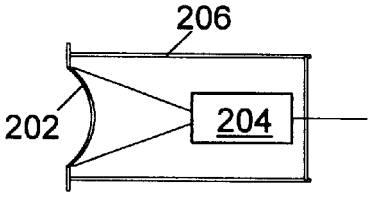
Figure 2C:
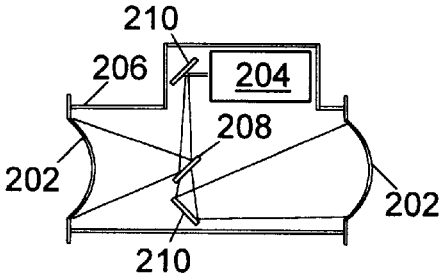

Referring now to FIGS. 2A–2C, alternative embodiments of a display device in accordance with a preferred embodiment of the present invention are depicted. Display device 108 includes at least the minimum components required for a SurroundView™ display system, available from RediFun Stimulation, Inc. of Southlake, Tex., as disclosed in copending, commonly assigned U.S. Pat. No. 5,864,431 entitled "METHOD AND APPARATUS FOR ELIMINATION OF DISTORTION IN REAR PROJECTION TO CURVED SURFACES," which is incorporated herein by reference.

FIG. 2A depicts a first embodiment of the display device including a curved display screen 202 comprising an acrylic or polycarbonate translucent material such as is conventionally employed in rear projection systems. However, display screen 202 is curved, forming a bubble-shaped surface having a nearly hemispherical geometry. Display screen 202 may thus wrap around a child within the modular playground structure to which the display device is attached, filling the child's field of vision. Display screen 202 may fit over a clear portal on the compartment of the modular playground structure, or may replace the clear portal material. The material of display screen 202 is sufficiently durable to preclude fracturing by most contact of the type which may be expected from children.

In the embodiment depicted in FIG. 2A, projection device 204 is situated to project an image onto the outer surface of display screen 202, the surface outside the compartment of the modular playground structure. The projected image passes through translucent display screen 202 and is viewed by a child inside the compartment of the modular playground structure. In the exemplary embodiment, the image may also be seen by individuals outside the compartment.

Projection device 202 may be a liquid crystal display (LCD) projection device such as are available from various commercial sources, including, for example, the Sharp XGNV1U Notevision Projector available from Sharp Corporation.

FIG. 2B depicts a second embodiment of the display device in which the display screen 202 and projection device 204 are encapsulated in an enclosure capsule 206 which readily attaches to the modular playground structure. Enclosure capsule 206 may be fabricated of the same material having the same or a complementary color to the modular playground compartment to which the display device is being attached. In this embodiment, the image projected onto display screen 202 by projection device 204 may only be viewed by children within the modular playground compartment, and not by individuals outside the compartment. However, one side of display screen 202 and projection device 204 are protected by enclosure 206 and therefore should be protected from damage. Enclosure 206 may also obviate any necessity for cleaning one surface of display screen 202.

FIG. 2C depicts a third embodiment of the display device including two display screens 202, one at either end of encapsulating enclosure 206. Beam splitter 208 and mirrors 210 allow the image projected by projection device 204 to be viewed from either display screen 202, thus allowing children within a modular playground compartment and individuals outside, such as parents, to view the same image. This is particularly useful where the image projected by projection device 204 comprises captured video of children within the modular playground structure.

Figure 2D:
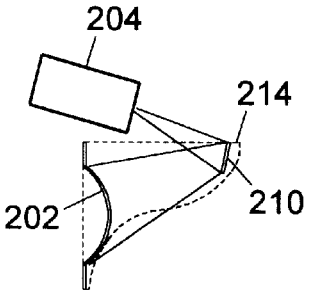
Figure 2E:
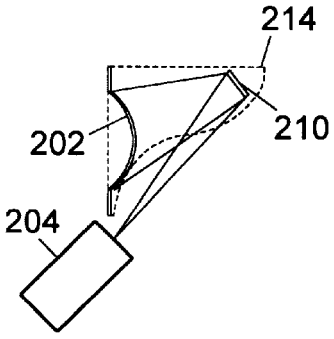

FIG. 2D depicts a fourth embodiment of the display device. This embodiment also includes fold mirror 210 between projection device 204 and display screen 202, but includes light shield 214 (depicted in dashed lines) made from an opaque material and surrounding the sides of display screen 202 and fold mirror 210. Light shield 214 is disposed around the horizontal sides of display screen 202 and fold mirror 210, and is open on the top and bottom. Light shield 214 blocks ambient light from creating a glare on display screen 202, and darkens the area around display screen 202 to provide better contrast. As shown in FIG. 2E, projection device 204 may be placed either above or below display screen 202 when utilizing fold mirror 210 and light shield 214.

In each of the embodiments depicted above, a flat display screen may be utilized rather than a hemispherical or bubble shaped screen. In such instances, less distortion may be apparent to the viewer. However, bubble shaped display screens more closely conforms to existing "fish-eye" portals in conventional modular playgrounds, and may occupy the full field of view of children viewing the display. Distortion, particularly in peripheral regions of the display screen which fill peripheral portions of the child field of view, may accordingly be of little concern.

The present invention provides display devices suitable for integration into modular playground structures. A bubble-shaped display screen is adapted to fit over a "fish-eye" portal to a modular playground compartment, and may either replace or augment the transparent portal window. A projection device projects video images into the display screen. The display screen and projection device may be contained within an encapsulating enclosure which readily attaches to the modular playground compartment over an existing portal, allowing retro-fitting of existing playground structures. A beam-splitter and mirrors permit the projected video image to be viewed on either of two display screens mounted on either end of the enclosure encapsulating the projection device, permitting children within the playground structure and individuals outside the playground structure to view the same image.

The description of the preferred embodiment of the present invention has been presented for purposes of illustration and description, but is not intended to be exhaustive or limit the invention in the form disclosed. Many modifications and variations will be apparent to those of ordinary skill in the art. The embodiment was chosen and described in order to best explain the principles of the invention and the practical application to enable others of ordinary skill in the art to understand the invention for various embodiments with various modifications as are suited to the particular use contemplated.

What is claimed is:

1. A visual display system, comprising:

a curved display screen adapted for attachment over a portal of a modular playground compartment, the display screen having a projection surface opposite a viewing surface and including:

a lip extending from a periphery of a nonplanar portion of the display screen; and a region extending from the periphery of the nonplanar portion toward a center of the display screen capable of receiving a projecting rim around the portal;

a film on the display screen for refracting a projected image; and a projection device for projecting the projected image onto the display screen.

2. The system of claim 1, further comprising:

a mirror for diverting the projected image; and a beam splitter capable of splitting and transmitting a complete image to at least two display screens.

3. The system of claim 1, wherein the film on the display screen for refracting a projected image further comprises:

a translucent material applied to the display screen.

4. The system of claim 1, wherein the projection device for projecting the prjected image onto the display screen further comprises:

an image generator;

an image projector coupled to the image generator and positioned to project the projected image onto the display screen.

5. The system of claim 4, wherein the image generator is a data processing system having image generation software.

6. The system of claim 1, further comprising:

a glare shield around a portion of the display screen.

7. The system of claim 6, further comprising:

a mounting bracket on the glare shield for mounting the projection device.

8. A modular playground structure, comprising:

a modular compartment having a portal; and a rear projection display screen affixed over the portal, the display screen having a projection surface opposite a viewing surface and including a translucent film refracting an image projected onto the projection surface for viewing on the viewing surface.

9. The modular playground structure of claim 8, wherein the modular compartment further comprises:

at least one opening in the compartment permitting passage by a child to and from an adjacent modular playground compartment.

10. The modular playground structure of claim 8, wherein the display screen further comprises:

a shatter resistant, transparent acrylic or polycarbonate material coated with the translucent film.

11. A kit for retrofitting an existing modular playground structure, comprising:

a display screen fitting over a portal covering on a modular playground compartment, the display screen having a projection surface opposite a viewing surface and including a translucent film refracting an image projected onto the projection surface for viewing on the viewing surface;

a projection device for projecting the image onto the display screen; and a mount for mounting the projection device in fixed relation to the display screen on the existing modular playground structure.

12. The kit of claim 11, wherein the display screen further comprises:

the display screen having a diameter in a range of 24 inches to 48 inches.

13. The kit of claim 11, wherein the display screen is hemispherical.

14. The kit of claim 11, wherein the display screen includes a lip extending from a periphery of a display area of the display screen.

15. The kit of claim 11, wherein the display screen includes a lip extending from a periphery of a hemispherical portion of the display screen.

16. The kit of claim 11, wherein the display screen includes a concave portion receiving the portal covering.

17. The kit of claim 11, wherein the display screen includes a concave portion receiving a projecting rim around a portal including the portal covering.

18. The kit of claim 11, wherein the mount further comprises:

a glare shield affixed to the modular playground compartment around a portion of the display screen.

* * * * *